US010060448B2

(12) United States Patent
Heli et al.

(10) Patent No.: US 10,060,448 B2
(45) Date of Patent: Aug. 28, 2018

(54) FAN AND ASSOCIATED SUPPORT ELEMENT

(71) Applicants: ebm-papst Mulfingen GmbH & Co. KG, Mulfingen (DE); Kelvion Refrigeration GmbH, Baierbrunn (DE)

(72) Inventors: Thomas Heli, Langenburg (DE); Peter Riegler, Boxberg (DE); Joerg Guenther, Doerzbach (DE); Gheorghe-Mircea Seculi, Germering (DE); Christoph Korinth, Murnau (DE)

(73) Assignees: ebm-papst Mulfingen GmbH & Co. KG, Mulfingen (DE); Kelvion Refrigeration GmbH, Baierbrunn (DE)

( * ) Notice: Subject to any disclaimer, the term of this patent is extended or adjusted under 35 U.S.C. 154(b) by 254 days.

(21) Appl. No.: 14/433,968

(22) PCT Filed: Sep. 12, 2013

(86) PCT No.: PCT/EP2013/068925
§ 371 (c)(1),
(2) Date: Apr. 7, 2015

(87) PCT Pub. No.: WO2014/056671
PCT Pub. Date: Apr. 17, 2014

(65) Prior Publication Data

US 2015/0275923 A1 Oct. 1, 2015

(30) Foreign Application Priority Data

Oct. 8, 2012 (DE) ..... 10 2012 109 518

(51) Int. Cl.
*F04D 29/64* (2006.01)
*F04D 29/60* (2006.01)
(Continued)

(52) U.S. Cl.
CPC ..... *F04D 29/644* (2013.01); *F04D 19/002* (2013.01); *F04D 25/068* (2013.01);
(Continued)

(58) Field of Classification Search
CPC .... F04D 29/522; F04D 29/644; F04D 29/646; F04D 19/002; F04D 25/0693;
(Continued)

(56) References Cited

U.S. PATENT DOCUMENTS 2,594,688 A * 4/1952 Shapiro ..... F24F 7/013 248/674
2,619,021 A * 11/1952 Pfautsch ..... F04D 29/646 174/50
(Continued)

FOREIGN PATENT DOCUMENTS

CN 1148932 C 5/2004
CN 201297262 Y 8/2009
(Continued)

OTHER PUBLICATIONS

International Search Report of PCT/EP2013/068925, dated Jan. 8, 2014.
(Continued)

*Primary Examiner* — Logan Kraft
*Assistant Examiner* — Peter T Hrubiec
(74) *Attorney, Agent, or Firm* — Collard & Roe, P.C.

(57) ABSTRACT

A fan, in particular an axial fan, comprising a support element with a wall ring and an electric fan motor which is mounted in the wall ring and comprises a fan rotor. The wall ring has on its outer periphery a hinge consisting of a first hinge part that is connected to the wall ring and a second hinge part that can be pivoted about a hinge axis relative to the first hinge part, wherein the second hinge part is designed as a terminal box for receiving electrical connec-
(Continued)

Figure 1:
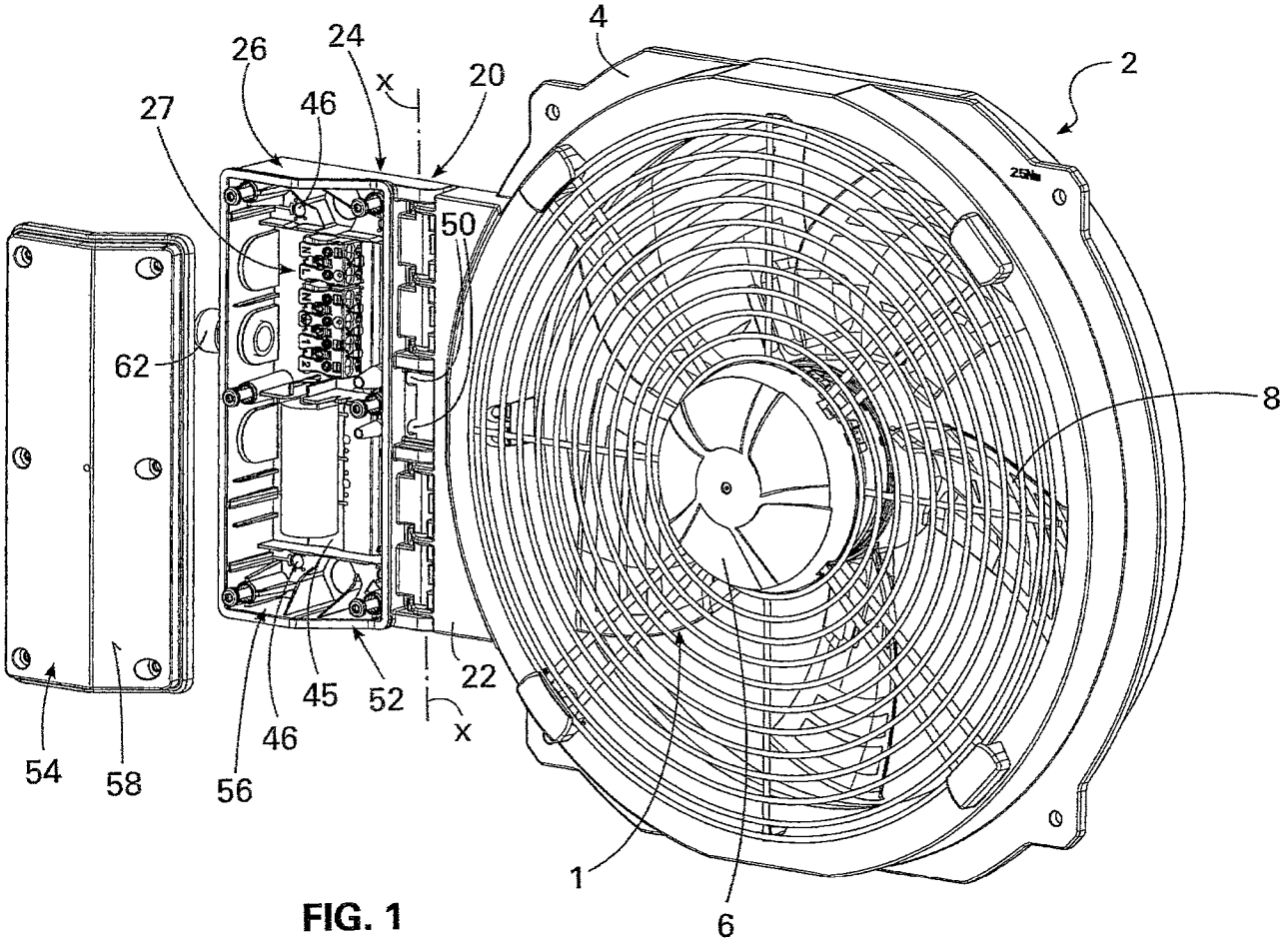

tors. The invention further relates to a support element for such a fan.

21 Claims, 4 Drawing Sheets

(51) Int. Cl.
*F04D 25/06* (2006.01)
*F04D 19/00* (2006.01)
*F04D 29/52* (2006.01)
*F04D 25/08* (2006.01)

(52) U.S. Cl.
CPC ..... *F04D 25/0693* (2013.01); *F04D 25/08* (2013.01); *F04D 29/522* (2013.01); *F04D 29/601* (2013.01); *F04D 29/646* (2013.01)

(58) Field of Classification Search
CPC ..... F04D 25/08; F04D 25/12; E05D 7/1055; E05D 7/1066; E05D 7/1077; F24F 7/013; H05K 5/0226
See application file for complete search history.

(56) References Cited

U.S. PATENT DOCUMENTS

| | | | |
|---|---|---|---|
| 2,697,163 | A | 12/1954 | Spear |
| 4,838,151 | A | 6/1989 | Shin-Chin |
| 6,123,401 | A | 9/2000 | Chiba et al. |

FOREIGN PATENT DOCUMENTS

| | | | |
|---|---|---|---|
| EP | 1 739 367 | A1 | 1/2007 |
| GB | 749 685 | A | 5/1956 |
| JP | 2000-303998 | A | 10/2000 |
| RU | 2 307 957 | C2 | 10/2007 |
| WO | 93/02291 | A1 | 2/1993 |

OTHER PUBLICATIONS

International Preliminary Report on Patentability of PCT/EP2013/068925, dated Apr. 9, 2015.

* cited by examiner

FAN AND ASSOCIATED SUPPORT ELEMENT

CROSS REFERENCE TO RELATED APPLICATIONS

This application is the National Stage of PCT/EP2013/068925 filed on Sep. 12, 2013, which claims priority under 35 U.S.C. § 119 of German Application No. 10 2012 109 518.3 filed on Oct. 8, 2012, the disclosures of which are incorporated by reference. The international application under PCT article 21(2) was not published in English.

The present invention, according to the preamble of claim 1, relates to a fan, particularly an axial fan, having a support element having a wall ring and an electric fan motor mounted in the wall ring, having a fan rotor.

Furthermore, the invention also relates to a support element for such a fan.

Fans, particularly axial fans, are frequently used in refrigeration technology and air conditioning technology to convey air through heat exchangers. For this purpose, a fan is mounted on an installation wall in the region in front of a wall opening, by way of its support element, in each instance, in such a manner that the air conveyed by the fan flows through the heat exchanger disposed behind the wall opening. For reasons of hygiene, such heat exchangers must be cleaned after specific periods of operation. For this purpose, it was previously necessary to completely remove the fan with its support element, in other words to remove the entire wall ring, as it is called, from the installation wall, in order to make the heat exchanger accessible for cleaning. This led to a great expenditure of time and labor.

EP 1 739 367 A1, for example, discloses a fan arrangement for use in air conditioning technology. The fan arrangement comprises a plurality of axial fans that are disposed in a support in pairs. The supports are held in a frame so as to pivot about their longitudinal axis. The direction of the fluid stream can be adjusted by means of independent pivoting of the supports about their longitudinal axis. Electrically connecting the axial fans takes place within the frame on which the supports are attached.

U.S. Pat. No. 2,697,163 discloses a fan that is held in a housing with its wall ring, so as to pivot about a hinge. The housing serves for fixed installation, so that after installation, the fan can be pivoted out of the housing, for example for maintenance purposes. Electrically connecting the fan takes place by way of the terminal box on the housing.

U.S. Pat. No. 4,838,151 discloses a fan that is disposed between two frame plates that can pivot. In this connection, the pivot axis of the frame plates is disposed orthogonal to the axis of rotation of the fan, wherein the frame plates can be moved independent of one another. The frame plates serve for installation of the fan in a building opening, for example a window, and, at the same time, for closing off the remaining part of the building opening.

JP 2000 303998 A discloses a fan having a wall ring, wherein a groove for guiding connection lines, particularly of the motor, is provided within the wall ring. The groove can be closed off, for example, with a closure element held on the wall ring so as to pivot, so that reliable mounting of the connection lines is guaranteed.

WO 93/02291 A1 discloses a fan that can be mounted in a pipeline. For maintenance purposes, the fan or the rotor can be pivoted out of the region of the pipeline with part of the wall ring. Electrically connecting the fan takes place by way of an interface that is automatically separated when the fan or the wall ring is pivoted out, and is connected when it is pivoted back.

GB 749,685 discloses a fan, particularly an axial fan, that can be mounted within a pipeline. For maintenance purposes, the fan is held so as to pivot, in such a manner that it can be pivoted out of the region of the pipeline.

The present invention is based on the task of improving a fan of the type described, in such a manner that the maintenance work described above is further simplified.

According to the invention, this is achieved by means of a fan as disclosed herein. Advantageous embodiments of the invention are also disclosed. A special support element for the fan according to the invention is also attached.

Accordingly, it is provided, according to the invention, that the wall ring has a hinge on its outside circumference, which hinge consists of a first hinge part firmly connected with the wall ring and a second hinge part that can pivot relative to the first hinge part, about a hinge axis, wherein the second hinge part is configured as a terminal box for accommodation of electrical connectors, and wherein the two hinge parts have bearing accommodations that align with one another in the direction of the hinge axis, on the one hand, and bearing journals, on the other hand, which are joined together in a joining direction that lies perpendicular to the hinge axis. In that the second hinge part is also attached to the installation wall, in each instance, in the region next to the wall opening, the wall ring only needs to be released from the wall for later maintenance work, but remains connected with the installation wall by way of the hinge and the terminal box, so that complete removal is eliminated. The entire fan can then easily and conveniently be pivoted away from the wall opening by way of the articulated hinge suspension of the wall ring, in the manner of a hinged lid or door.

Figure 2:
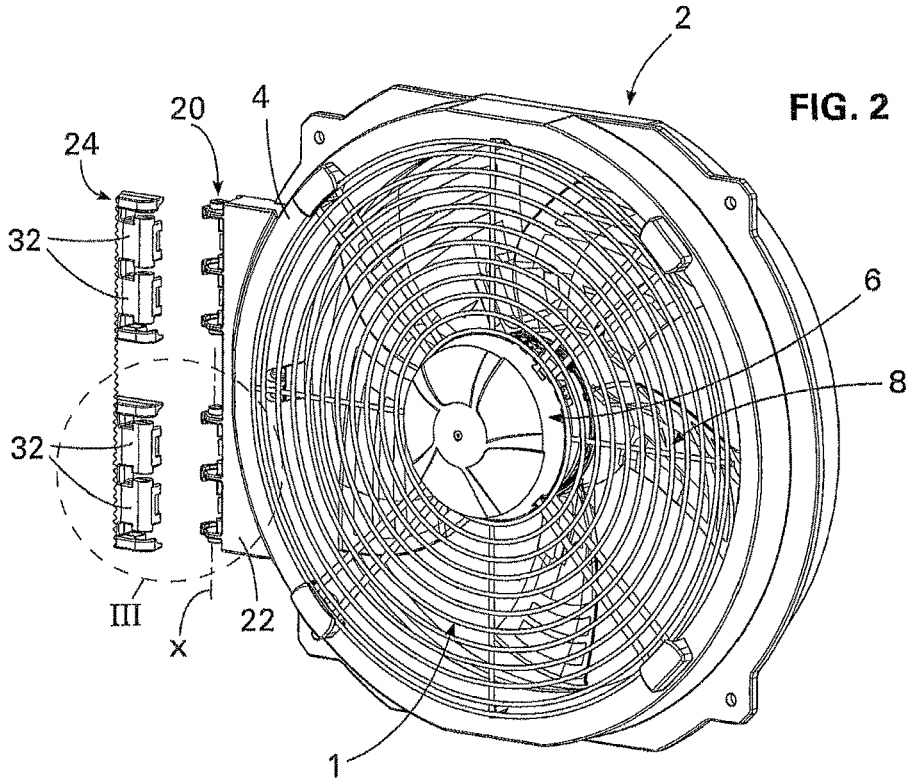
Figure 3:
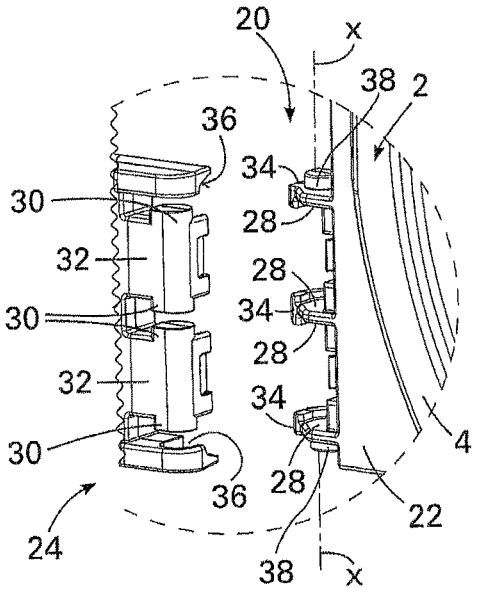
Figure 4:
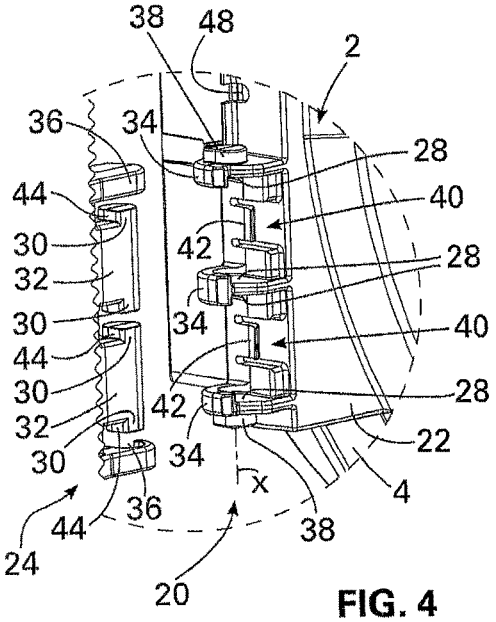
Figure 5:
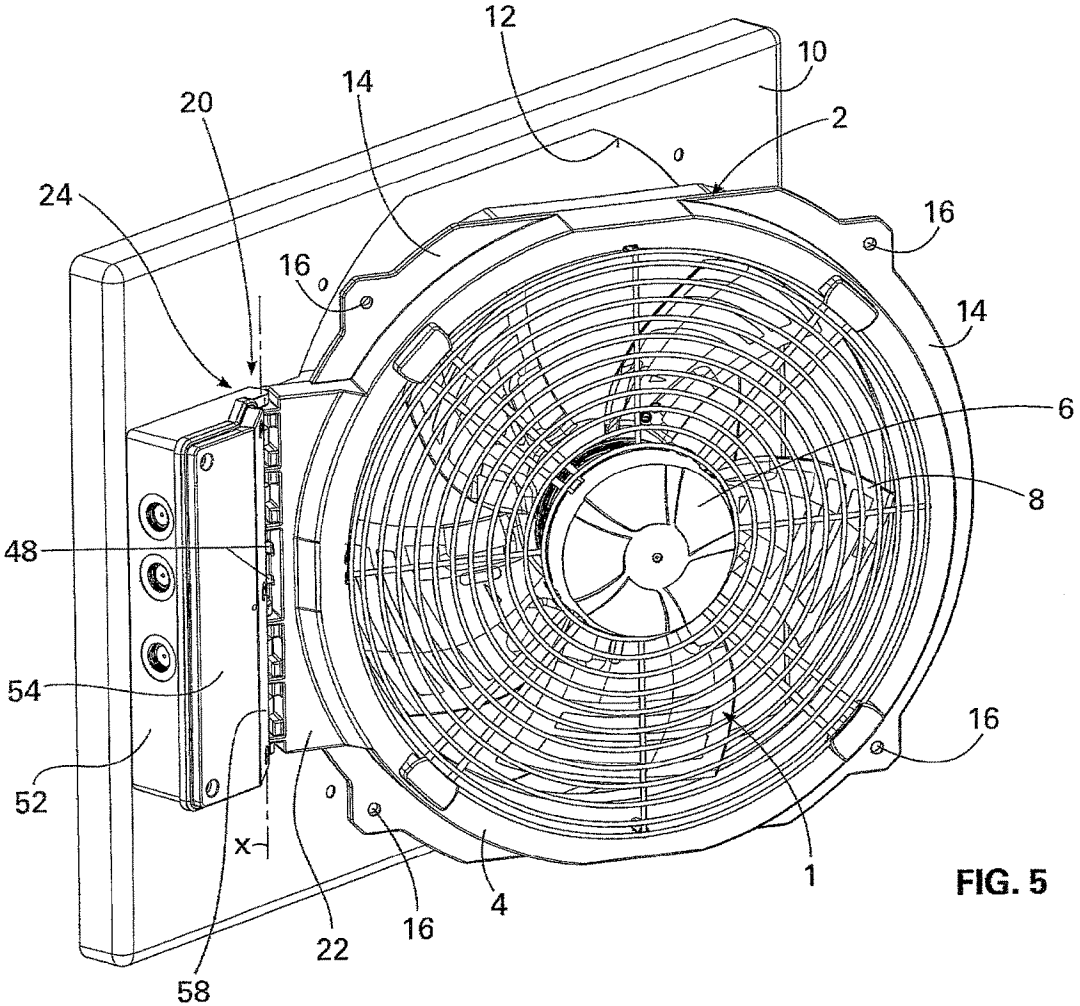
Figure 8:
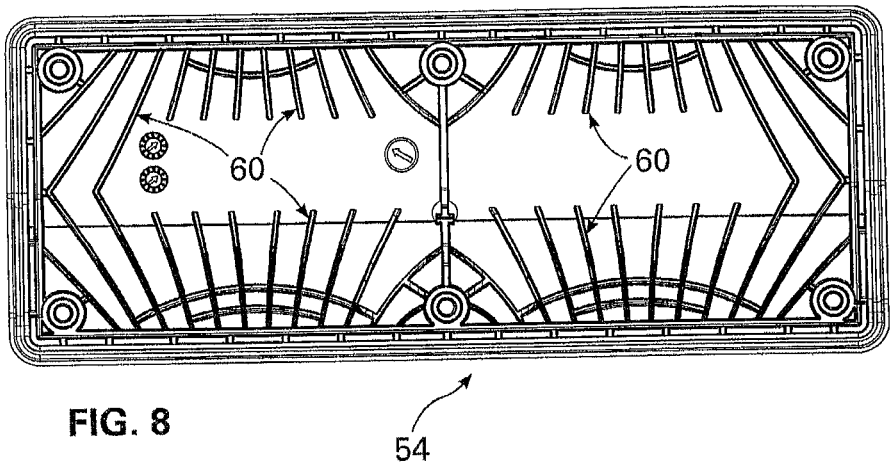
Figure 7:
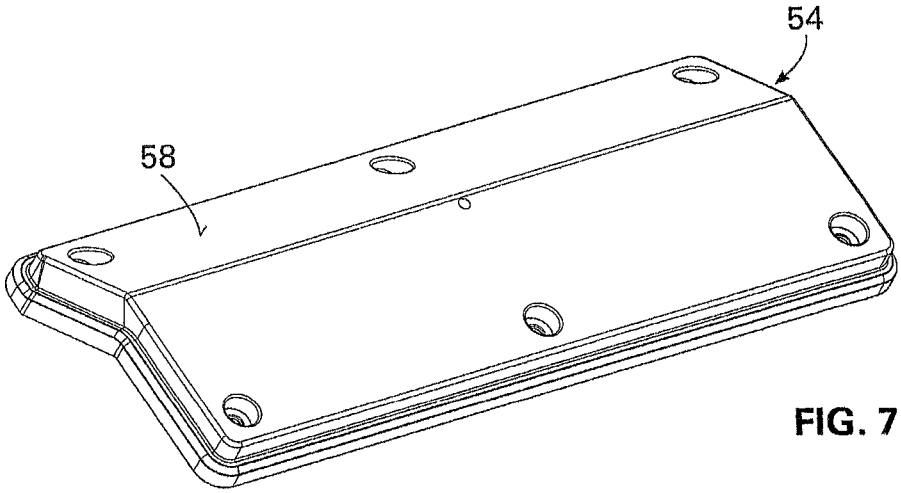
Figure 6:
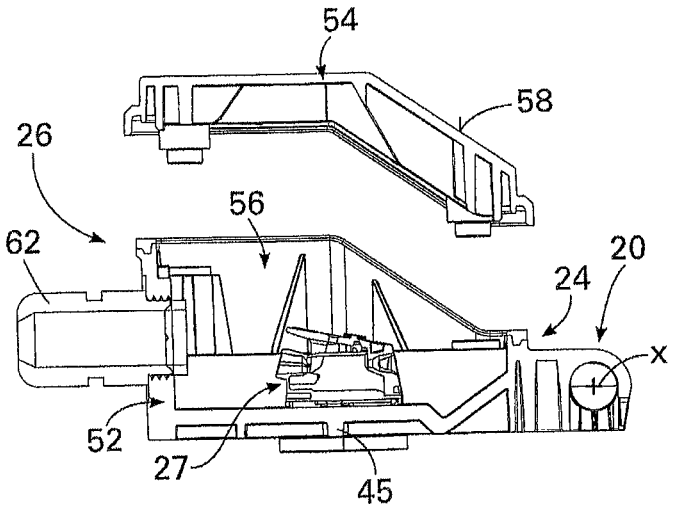

Using a preferred exemplary embodiment illustrated in the drawing, the invention will be explained in further detail below. The drawing shows:

FIG. 1 a perspective representation of a fan according to the invention, having a support element and a hinge according to the invention, FIG. 2 a further perspective view of the fan according to FIG. 1, from a different viewing direction and in an exploded representation of the hinge, FIG. 3 a detail enlargement of the region III in FIG. 2, FIG. 4 a view as in FIG. 3, but in a different viewing direction, FIG. 5 a perspective view of the fan in an installed state, together with an installation wall and with a fan that can be pivoted by way of the hinge, FIG. 6 a cross-section through the terminal box forming the second hinge part, with the lid open, analogous to FIG. 1, FIG. 7 a separate perspective view of the lid on its outside, and FIG. 8 a view of the inside of the lid.

In the different figures of the drawing, the same parts are always provided with the same reference symbols.

With regard to the following description, it is being explicitly emphasized that the invention is not restricted to the exemplary embodiments, and, in this connection, not to all or multiple characteristics of combinations of characteristics that are described; instead, each individual partial characteristic of the/each exemplary embodiment can have inventive significance in and of itself, even separately from all the other partial characteristics described in connection with it, and also in combination with any desired characteristics of another exemplary embodiment, and also independent of the combinations of characteristics and antecedents of the claims.

As is first of all evident from FIG. 1, a fan 1 is configured as an axial fan in the preferred exemplary embodiment shown. The fan 1 has a support element 2 having what is called a wall ring 4. An electric fan motor 6 having a fan rotor 8 is attached centrally in the wall ring 4.

According to FIG. 5, the fan 1 can be attached to an installation wall 10 in the region in front of a wall opening 12 by way of its wall ring 4, for which purpose the wall ring 4 preferably has a flange-like holding section 14 with installation holes 16.

According to the invention, the wall ring 4 has a hinge 20 at a location of its outside circumference. This hinge 20 consists of a first hinge part 22 firmly connected, particularly in one piece, with the wall ring 4, and a second hinge part 24 that can be pivoted about a hinge axis X relative to the first hinge part 22. The hinge axis X preferably runs tangential to the wall ring 4, or—as shown—offset outward parallel to a tangent to the wall ring 4, and in a ring plane defined by the wall ring 4. The second hinge part 24 is configured as a terminal box 26, wherein this terminal box 26 contains connectors 27 (FIGS. 1 and 6) for connecting motor lines that lead to the fan motor 6 with external connection lines. The terminal box 26 will be described in greater detail below.

The first hinge part 22 is preferably configured as a molded part in one piece with the wall ring 4, particularly composed of plastic.

As is particularly evident from the detail enlargements in FIGS. 3 and 4, the two hinge parts 22, 24 have bearing accommodations 28 that align in the direction of the hinge axis X, on the one hand, and bearing journals 30, on the other hand. In this connection, the bearing journals 30 are set into the bearing accommodations 28 in a joining direction that lies perpendicular to the hinge axis X. For this purpose, the bearing accommodations 28 are configured as open bearing shells, in accordance with the joining direction. The second hinge part 24 has multiple journal extensions 32, that extend perpendicular to the hinge axis X, each having two opposite axial bearing journals 30, wherein each journal extension 32 engages, in gear-like manner, between two accommodation extensions 34 of the first hinge part 22, and, with its bearing journals 30, into opposite, corresponding bearing accommodations 28 of the accommodation extensions 34. In a preferred embodiment, the second hinge part 24 additionally overlaps with axial bearing journals 38 of the first hinge part 22 with lateral bearing accommodations 36.

Preferably, the terminal box 26 forming the second hinge part 24 has two times two journal extensions 32, so that the hinge 20, in total, has four journal extensions 32 each having two bearing journals 30. Therefore, in total, eight bearing journals 30 lie one behind the other in corresponding bearing accommodations 28, in the direction of the hinge axis X. Great mechanical stability of the hinge 20 results from this, as a result of the great bearing length, and the hinge is therefore also suitable for large and heavy fans 1.

Preferably, the hinge parts 22, 24 that are joined together perpendicular to the hinge axis X are fixed in place to prevent loosening by way of engagement means 40 (see FIG. 4), so that the hinge parts 22, 24 are already securely held together in the delivered state of the fan 1, before it is attached to an installation wall 10. As is evident from FIG. 4, these engagement means 40 can be formed by spring-elastic engagement extensions 42 of the first hinge part 22, wherein the engagement extensions 42 are disposed and configured in such a manner that they engage behind the journal extensions 32 of the second hinge part 24, locking in place, after the hinge parts 22, 24 have been joined together.

In addition, it is provided, in a preferred embodiment, that the hinge parts 22, 24 can be joined together and separated only in a defined relative pivot position. In the exemplary embodiment shown, this is achieved in that each bearing journal 30—see, in this regard, particularly FIG. 4—has a lateral flattened area 44, by means of which the cross-section of the bearing journal 30 is reduced relative to the region without a flattened area 44. In this connection, each shell-shaped bearing accommodation 28 has a narrow introduction opening in the region of the flattened area 44, corresponding to the cross-section of the bearing journal 30. As a result, the bearing journals 30 are held in the bearing accommodations 28 with shape fit in all other pivot positions, to prevent them from coming loose, because they then do not fit through the narrowed introduction openings of the bearing accommodations 28 with their complete diameter.

As is evident from FIG. 5, the second hinge part 24 can be attached on the installation wall 10 in the region next to the wall opening 12. For this purpose, the second hinge part 24 or the terminal box 26 has installation holes 46 for attachment screws, not shown, in the region of a bottom 45, see FIG. 1. By means of attaching the second hinge part 24 to the installation wall 10, the entire fan 1—after the wall ring 4 has been loosened from the installation wall 10—can be pivoted away from the wall opening 12 in the manner of a door—see FIG. 5. In that the second hinge part 24 or the terminal box 26 is joined together with the first hinge part 22 from the side opposite to the installation wall 10, the first hinge part 22 with the wall ring 4 can no longer come loose from the second hinge part 24 after the second hinge part 24 has been attached to the installation wall 10, because the accommodation extensions 34 with the bearing accommodations 28 are held to prevent them from coming loose, by way of the journal extensions 32 with the bearing journals 30.

It should still be noted that the wall ring 4, particularly in a center region of the first hinge part 22, viewed in its circumference direction, has at least one cable introduction opening 48 for a motor cable (not shown) to be passed to the fan motor 6. According to FIG. 5, preferably two introduction openings 48 are provided. The corresponding motor lines are passed from the interior of the terminal box 26, particularly through its bottom 45, and, according to FIG. 1, through lateral passages 50, in the direction of the wall ring 4 and through the introduction opening 48, in each instance.

Furthermore, preferably the second hinge part 24 is configured in one piece with the lower box part 52 of the terminal box 26, particularly as a plastic molded part. The terminal box 26 or its lower part 52 has a box opening 56 that is or can be tightly sealed with a lid 54.

In a preferred embodiment, the terminal box 26 has a reduced box depth, by way of a slanted surface 58 of the lid 54, in its front side region facing the hinge 20. In this regard, reference is particularly made also to FIG. 6. By means of this slanted surface 58, the pivot region of the first hinge part 22 with the wall ring 4 is advantageously increased in size, because a clear space to prevent collisions with the pivoted fan 1 is created by means of the slanted surface 58.

As is also evident from FIG. 8, the lid 54 advantageously has an inner reinforcement ribbing 60.

According to FIG. 6, the terminal box 26 furthermore has at least one line conduit 62 for a sealed cable pass-through in a side wall of the lower part 52.

The invention is not restricted to the exemplary embodiments that are shown and described, but rather comprises all embodiments that have the same effect, in the sense of the invention. It is being explicitly emphasized that the exemplary embodiments are not restricted to all the characteristics in combination; instead, each individual partial characteristic can have inventive significance in and of itself, even separately from all the other partial characteristics. Furthermore, the invention is also not restricted to the combination of characteristics defined in each independent claim, until now, but rather can also be defined by any other desired combination of specific characteristics of all the individual characteristics disclosed in total. This means that fundamentally, practically any individual characteristic of the independent claim, in each instance, can be left out or replaced by at least one other individual characteristic disclosed at another point of the application. In this regard, the claims should be understood to be merely a first formulation attempt for the invention.

The invention claimed is:

1. A fan, comprising:

a support element having a wall ring; and an electric fan motor mounted in the wall ring, having a fan rotor, wherein the wall ring has a hinge on its outside circumference, which hinge consists of a first hinge part firmly connected with the wall ring and a second hinge part that can pivot relative to the first hinge part, about a hinge axis (X), wherein the second hinge part is configured as a terminal box, wherein the terminal box is mounted outside of the wall ring and contains connectors, and wherein the two hinge parts have bearing accommodations that align with one another in the direction of the hinge axis, on the one hand, and bearing journals, on the other hand, which are joined together in a joining direction that lies perpendicular to the hinge axis (X).

2. A fan according to claim 1, wherein the hinge axis (X) runs as a tangent to the wall ring, or offset outward parallel to a tangent to the wall ring, and in a ring plane defined by the wall ring and wherein said terminal box is positioned on an opposite side of the hinge axis than the electric fan motor and wherein said connectors are disposed in a region separate from said electric fan motor.

3. A fan according to claim 1, wherein the first hinge part is connected in one piece with the wall ring and wherein said second hinge part is disposed adjacent to, and outside of a region of said wall ring.

4. A fan according to claim 1, wherein the bearing accommodations are configured as open bearing shells, in accordance with the joining direction.

5. A fan according to claim 1, wherein the second hinge part has multiple journal extensions extending perpendicular to the hinge axis (X), each having two opposite axial bearing journals, wherein each journal extension engages, in gear-like manner, between two accommodation extensions of the first hinge part, and, with its bearing journals, into opposite bearing accommodations of the accommodation extensions.

6. A fan according to claim 1, wherein the second hinge part additionally overlaps with axial bearing journals of the first hinge part with bearing accommodations.

7. A fan according to claim 1, wherein the joined hinge parts are fixed in place to prevent them from coming loose, by way of engagement means.

8. A fan according to claim 1, wherein the hinge parts can be joined together and separated only in a defined relative pivot position.

9. A fan according to claim 1, wherein the wall ring can be attached to an installation wall in the region of a wall opening, for which purpose the wall ring preferably has an outer flangelike holding section with installation holes.

10. A fan according to claim 1, wherein the second hinge part can be attached on an installation wall in the region next to a wall opening, for which purpose the terminal box has installation holes in the region of a bottom.

11. A fan according to claim 1, wherein the wall ring, in the circumference direction, has at least one cable introduction opening.

12. The fan according to claim 11, wherein the wall ring, in a center region of the first hinge part, in the circumference direction, has at least one cable introduction opening.

13. A fan according to claim 1, wherein the second hinge part is configured in one piece with a bottom box part of the terminal box.

14. A fan according to claim 1, wherein the terminal box has a box opening that is tightly sealed with a lid and wherein said lid is made of a solid plate configured to prevent air or fluid from passing through.

15. A fan according to claim 14, wherein the lid has an inner reinforcement ribbing.

16. A fan according to claim 1, wherein the terminal box has a reduced box depth, by way of a slanted surface, in its front side region facing the hinge.

17. Support element for a fan according to claim 1, having a wall ring for accommodation of a fan motor, wherein the wall ring has a hinge on its outside circumference, which hinge consists of a first hinge part firmly connected with the wall ring and a second hinge part that can pivot relative to the first hinge part, about a hinge axis (X), wherein the second hinge part is configured as a terminal box for accommodation of electrical connectors.

18. Support element according to claim 17, wherein the fan is an axial fan comprising:

a support element;

a wall ring; and an electric fan motor mounted in the wall ring, the motor having a fan rotor, wherein the wall ring has a hinge on its outside circumference, which hinge consists of a first hinge part firmly connected with the wall ring and a second hinge part that can pivot relative to the first hinge part, about a hinge axis (X), wherein the second hinge part is configured as a terminal box for accommodation of electrical connectors, and wherein the two hinge parts have bearing accommodations that align with one another in the direction of the hinge axis (X), on the one hand, and bearing journals, on the other hand, which are joined together in a joining direction that lies perpendicular to the hinge axis (X) wherein the hinge axis (X) runs as a tangent to the wall ring, or offset outward parallel to a tangent to the wall ring, and in a ring plane defined by the wall ring.

19. The support element as in claim 17, wherein with respect to the fan, the first hinge part is connected in one piece with the wall ring, and the bearing accommodations are configured as open bearing shells, in accordance with the joining direction.

20. The support element as in claim 19, wherein with respect to the fan, the second hinge part has multiple journal extensions extending perpendicular to the hinge axis (X), each having two opposite axial bearing journals, wherein each journal extension engages, in gear-like manner, between two accommodation extensions of the first hinge part, and, with its bearing journals, into opposite bearing accommodations of the accommodation extensions;

wherein the second hinge part additionally overlaps with axial bearing journals of the first hinge part with bearing accommodations; wherein the joined hinge parts are fixed in place to prevent them from coming loose, by way of engagement means; and wherein the hinge parts can be joined together and separated only in a defined relative pivot position.

21. A fan, comprising:

a support element having a wall ring; and an electric fan motor mounted in the wall ring, having a fan rotor, wherein the wall ring has a hinge on its outside circumference, which hinge consists of a first hinge part firmly connected with the wall ring and a second hinge part that can pivot relative to the first hinge part, about a hinge axis (X), wherein the second hinge part is configured as a terminal box, wherein the terminal box is mounted outside of the wall ring and contains for accommodation of electrical connectors, and wherein the two hinge parts have bearing accommodations that align with one another in the direction of the hinge axis, on the one hand, and bearing journals, on the other hand, which are joined together in a joining direction that lies perpendicular to the hinge axis (X), wherein the hinge axis (X) runs as a tangent to the wall ring, or offset outward parallel to a tangent to the wall ring, and in a ring plane defined by the wall ring and wherein said terminal box is positioned on an opposite side of the hinge axis than the electric fan motor and wherein said connectors are disposed in a region separate from said electric fan motor.

* * * * *